United States Patent [19]

Cooperberg et al.

[11] Patent Number: 4,497,558

[45] Date of Patent: Feb. 5, 1985

[54] DIFFUSION-TRANSFER PROCESSOR FOR PHOTOMECHANICAL REPRODUCTIONS

[75] Inventors: Bruce Cooperberg, North Hollywood; Gene E. Peck, Sun Valley, both of Calif.

[73] Assignee: Insta-Print, Inc., North Hollywood, Calif.

[21] Appl. No.: 550,790

[22] Filed: Nov. 14, 1983

[51] Int. Cl.[3] ..... G03D 9/00

[52] U.S. Cl. ..... 354/303; 354/305; 354/319

[58] Field of Search ..... 354/301, 302, 303, 305, 354/319

[56] References Cited

U.S. PATENT DOCUMENTS

| | | | |
|---|---|---|---|
| 3,143,056 | 8/1964 | Limberger | 354/303 |
| 3,202,072 | 8/1965 | Limberger | 354/305 |
| 3,455,229 | 7/1969 | Frohock | 354/319 |
| 3,695,163 | 10/1972 | Stievenart | 354/202 |
| 4,338,016 | 7/1982 | Peck et al. | 354/305 |

FOREIGN PATENT DOCUMENTS

| | | | |
|---|---|---|---|
| 1282479 | 12/1961 | France | 354/301 |

*Primary Examiner*—A. A. Mathews

*Attorney, Agent, or Firm*—Francis X. LoJacono

[57] ABSTRACT

An improved diffusion-transfer processor for photomechanical reproduction of artwork and like mediums of the type using negative and receiver materials, wherein the materials are passed through a chemical solution discharged through a bath assembly. The processor includes a separator positioned forwardly of and intermediately between two sets of transport rollers which are located one above the other. One sheet of material is placed above the separator and the other sheet of material is placed below the separator, both sheets being received in the respective transport rollers simultaneously with their emulsion surfaces facing each other. The upper sheet is fed over a liquid-dispenser bar, and the lower sheet is fed under the liquid-dispenser bar to allow the emulsion surface of the upper sheet to be bathed in the chemical solution. The two sheets of materials are brought together rearwardly of the bath assembly by means of a set of press rollers positioned to simultaneously accept both negative and receiver materials, whereby their emulsion surfaces are brought into direct contact for image transfer.

11 Claims, 6 Drawing Figures

10
14
94
85
86
88
5
30
12
18
4
20
28
80
82
84
16
74
75
76
78

10
114
112
30
60
90
120
94
14
110
111
88
86
30
34
20
46
32
42
12
20a
20b
28
18
80
78
82
16

DIFFUSION-TRANSFER PROCESSOR FOR PHOTOMECHANICAL REPRODUCTIONS

FIELD OF THE INVENTION

This invention relates generally to a diffusion-transfer processor, and more particularly to a diffusion-transfer-type apparatus that includes an improved bath assembly to establish a more accurate placement of the negative and receiver materials for a far superior image transfer.

DESCRIPTION OF THE PRIOR ART

This application is an improvement of a diffusion-transfer processor which is disclosed in U.S. Pat. No. 4,338,016 issued to the same inventors as in the present application. The above-noted patent is for a fully operational apparatus which provides a very satisfactory image transfer between negative material and the associated receiver material. However, the present invention includes an improved arrangement for transferring the negative and receiver materials through the bath assembly, so as to establish a more consistent surface alignment of the opposing negative and receiver materials.

The diffusion-transfer process well known in the art begins by providing an exposed negative paper, and then transferring the image directly to a receiver paper, film or printing plate. This method has afforded many advantages—mainly, the elimination of the negative, together with the exposing and developing of the final print which is generally referred to as "the carrier". Thus, the operation of producing a finished carrier is now much easier and faster, and it further improves the quality of the finished image. Moreover, cost is considerably reduced when compared to other methods employed in the graphic arts. Other background information relating to this subject matter can be found in the above-mentioned patent.

SUMMARY AND OBJECTS OF THE INVENTION

It is important to note that the present invention has for an important object to provide a diffusion-transfer processor that allows the negative paper and receiver paper to be selectively positioned relative to each other for accurately aligned transfer of one image to the other as the two papers are inserted into the diffusion-bath assembly. That is, after the exposure, the negative and receiver materials are properly placed so that their emulsion surfaces are face to face on the entrance shelf and are aligned with one another, the receiver sheet material generally being disposed on the top. The upper or receiver material is thus positioned above the separator bar; while the lower or negative material is positioned below the separator bar once the alignment of the sheets is accomplished. The transport motor is subsequently started, at which time both sheet materials are simultaneously fed into their respective sets of transport rollers.

It is another object to provide a diffusion-transfer processor that includes a bath assembly comprising a liquid-dispenser bar arranged and positioned to allow the negative and receiver sheets to be spaced apart, the emulsion side of the negative sheet being bathed in a flowing chemical solution as the receiver sheet passes under the liquid-dispenser bar. The two rearwardly moving sheets are angularly disposed so as to be received simultaneously by a pair of press rollers which press the opposing sheets together, the respective emulsion sides of the sheets making direct contact for positive transfer of the image from the negative to the receiver material.

Still another object of the present invention is to provide a new and unique diffusion-transfer bath assembly that is so arranged as to allow the activator solution to cover the entire surface of the emulsion-coated surface of the negative material prior to its engagement with the coated surface of the receiver material; and wherein neither sheet of material needs to be completely bathed in the activator solution.

A further object of the invention is to provide an apparatus of this character that is preferably provided with a continuous flow of activator fluid, either by a pumping system or by a gravity-feed method.

Still a further object of the invention is to provide an invention of this character that operates in a very simple manner under the most simple conditions, yet also provide a very reliable working unit with relatively few operating parts, the diffusion-transfer apparatus thus being easy to service and maintain.

A still further object of the present invention is to provide a diffusion-transfer processor that is designed to allow a straight-through paper path from input to output, and that accepts all types of materials without the need for special parts.

BRIEF DESCRIPTION OF THE DRAWINGS

Novel features and advantages of the present invention, in addition to those mentioned above, will become apparent to those skilled in the art from a reading of the following detailed description in conjunction with the accompanying drawings, wherein.

DESCRIPTION OF THE PREFERRED EMBODIMENT

Referring more particularly to the drawings, there is shown a diffusion-transfer processor, generally indicated at 10, the processor being also known as a photomechanical-transfer processor which uses a method to photograph copy and transfer the image directly to another carrier. The basic materials used in preparing camera-ready copy consists of (1) a light-sensitive negative paper, (2) a chemically sensitive paper or transparent film, (3) a ready-mixed processing fluid, which will be hereinafter referred to as the "activator solution", and (4) a processor.

As an example, a light-sensitive negative material is exposed to the copy by using a process camera or a contact-printing frame, after which the negative material is brought into emulsion-to-emulsion contact with chemically sensitive receiver material, the activator solution being applied to the emulsion-coated surface of the negative material.

Since there are several light-sensitive negative mediums, the term "negative paper" will be hereinafter used. Accordingly, there are various chemically sensitive receiver materials; and thus, for simplicity, the term "receiver paper" will be used to include any type of receiver mediums.

Figures 2, 3:
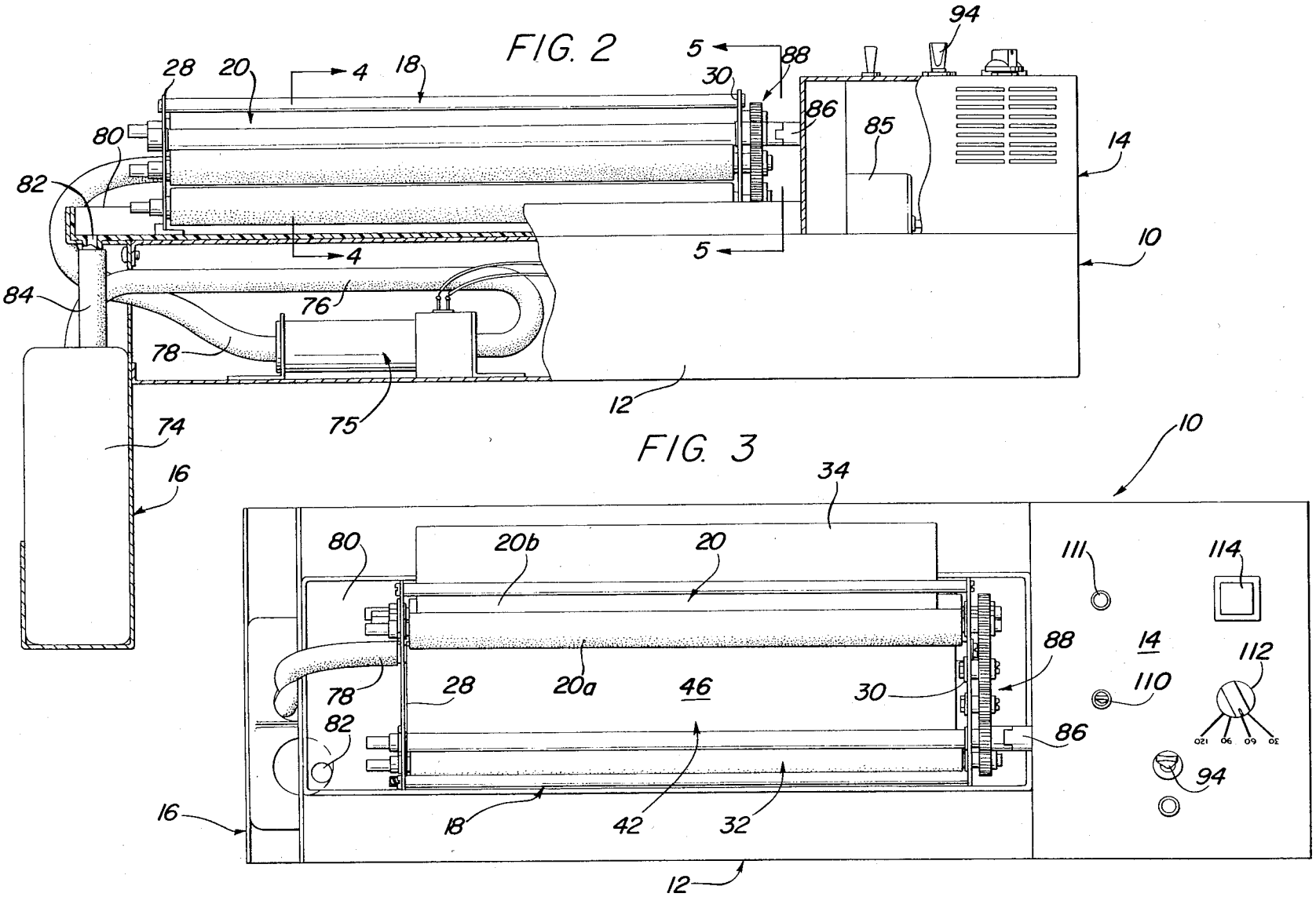
FIG. 2 is a side-elevational view thereof, with portions broken away to show the location of the continuous fluid-flow pump and the drive motor.
FIG. 3 is a top-plan view of the apparatus, with the in-and-out trays removed therefrom.

The diffusion-transfer apparatus 10 as herein illustrated comprises a frame structure defining an elongated housing 12 adapted to be supported on a table or like structure (not shown), and having a control box, designated generally at 14. Control box 14 is mounted at one end of the structure, and a reservoir or tank-support bracket 16 is formed at the opposite end thereof. Located between control box 14 and bracket 16 is the improved diffusion-transfer bath assembly, generally indicated at 18, which is mounted on housing 12 as seen in FIGS. 2 and 3.

Figure 1:
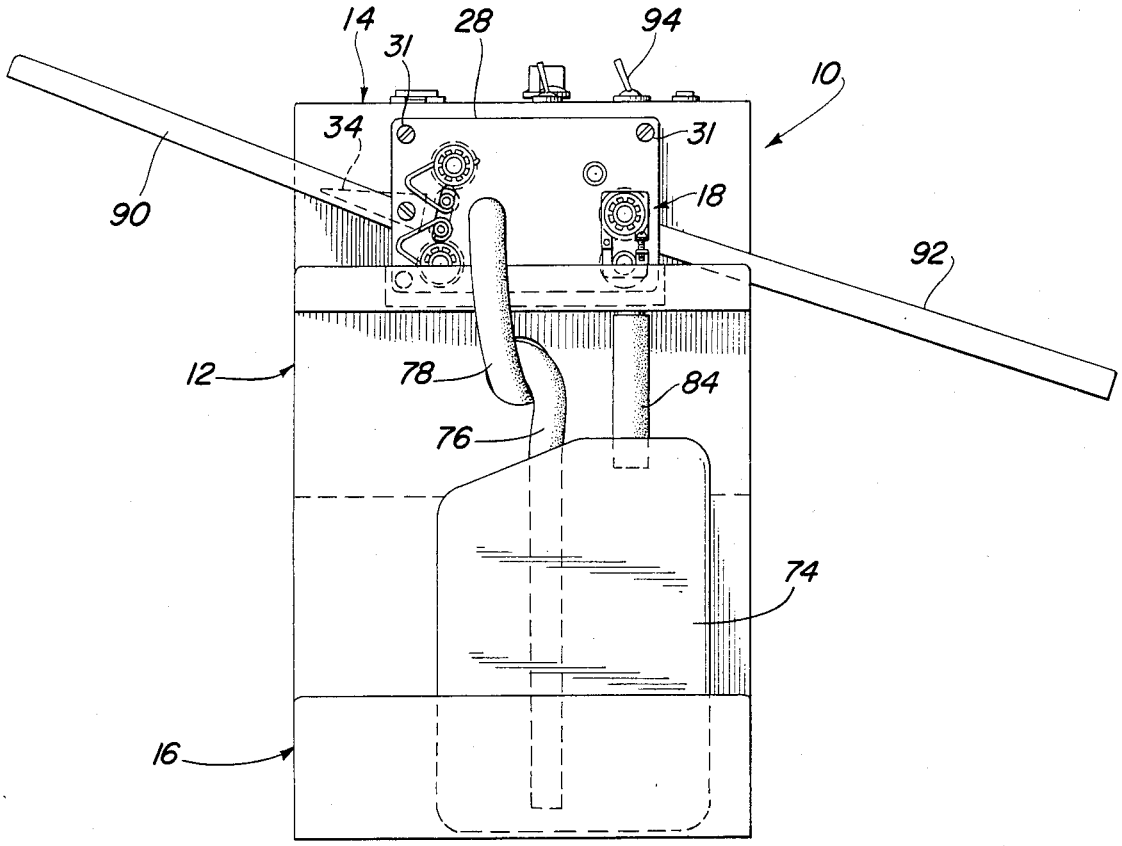
FIG. 1 is an end-elevational view of the improved diffusion-transfer processor, illustrating the positioning of the in-and-out trays with respect to the bath assembly.
Figure 4:
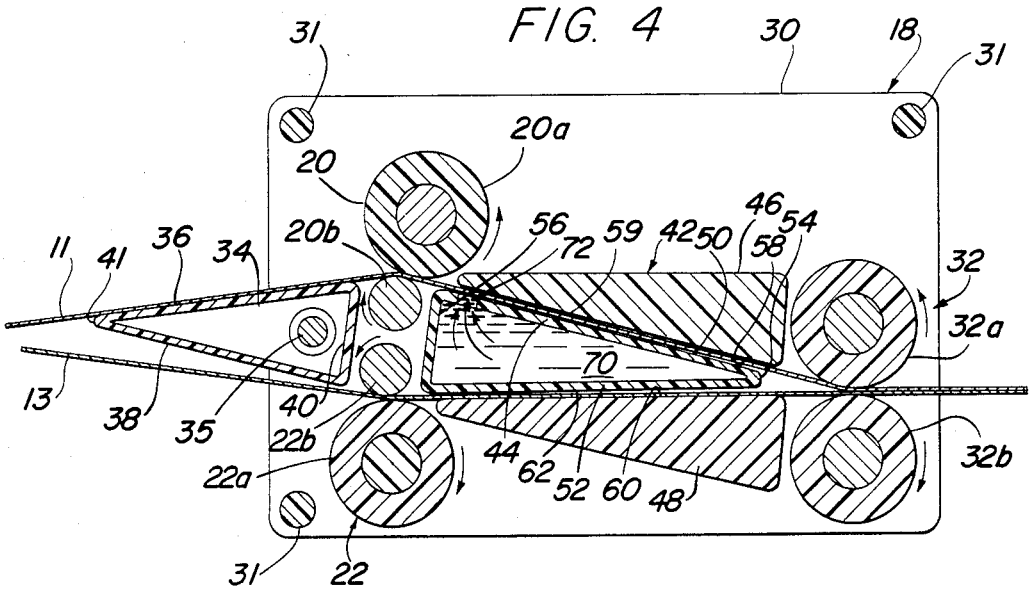
FIG. 4 is an enlarged cross-sectional view of the diffusion-transfer bath assembly, showing the typical operation and sequence of travel between the negative and receiver sheets as they pass through the bath assembly, this view being taken substantially along line 4—4 of FIG. 2.

The transfer bath assembly comprises a first set of transport rollers 20, which includes a first enlarged pliable roller 20*a* and a second lower roller 20*b*, arranged to contact each other, so as to engage the paper medium 11 and feed it rearwardly. A second set of transport rollers 22 is defined by a first enlarged pliable roller 22*a* and a second upper roller 22*b*, each roller engaging the other so as to transport the lower paper medium 13 rearwardly. It should be noted that the preferred positioning of the medium be such that the receiver paper 11 is placed through the upper first set of rollers, and the negative paper 13 is fed through the lower set of rollers as shown in FIG. 4. Each set of transport rollers is arranged longitudinally along housing 12 and is rotatably supported by end walls 28 and 30 which are held in place by tie rods 31. The first set of transport rollers 20 is positioned above the second set of transport rollers 22.

A third set of rollers 32 is also provided, but they are referred to as "press rollers" 32*a* and 32*b* which are also longitudinally disposed between end walls 28 and 30. However, the press rollers are located rearwardly of the two sets of transport rollers 20 and 22.

Positioned forwardly of and intermediately between the transport rollers 20 and 22 is a separator means which comprises a wedge-shaped separator bar defining upwardly and downwardly inclined wall members 36 and 38, respectively. A triangular cross-sectional configuration is completed by a rear base wall 40, the converging edges of walls 36 and 38 defining a leading edge 41 of the separator bar 34. Leading edge 41 extends forward outwardly from the side walls 28 and 30, the separator bar being attached by a rod 35 to the side walls.

In order to establish a continuous bathing process for the various papers or materials as they are transported between the forwardly disposed transport rollers and the rearwardly positioned press rollers 32, there is interposed therebetween a liquid-dispensing means 42 which includes a wedge-shaped liquid-dispensing bar 44, and a pair of guide bars 46 and 48, each guide bar being positioned above and below the liquid-dispensing bar. The liquid-dispensing bar is formed having a triangular cross-sectional configuration, whereby the upper wall 50 and the lower wall 52 converge rearwardly to define a trailing edge 54. The trailing edge is located adjacent the press rollers, and the base wall 56 of bar 44 is positioned adjacent the transport rollers. The lower surface 58 of guide bar 46 is angularly disposed so as to be parallel with the upper wall 50 of bar 44, thus defining a passageway 59 to receive paper 11 therethrough; while the upper surface 60 of guide bar 48 is angularly disposed so as to be parallel to the lower wall 52 of bar 44, thus defining a lower passageway 62 to receive negative paper 13 therebetween.

Normally, the receiver medium that passes through the upper portion (passageway 59) of the bath assembly 42 is bathed in the activator solution 70 as the solution is discharged through a plurality of longitudinally aligned holes or an elongated slot 72 formed in upper wall 50 of bar 44. The negative medium 13 is passed through the lower passageway 62, it being bathed with the excess fluid flowing through the passageway. The positioning of the negative and receiver papers can be reversed, depending upon the mediums and their specific requirements. However, it is important that the emulsion surface of each paper be turned inwardly in a face-to-face relationship, so that the opposing emulsion surfaces are covered with the chemical solution as they simultaneously pass through the bath assembly 42 and enter the rear set of press rollers 32*a* and 32*b*. Thus, the emulsion side of receiver paper 11 is totally bathed prior to engaging the lower negative paper 13, and the excess solution 70 is flowing over the emulsion side of paper 13.

The activator solution 70 is stored in a reservoir or tank 74 which is shown mounted in support bracket 16. It should be understood that reservoir 74 can be located at any given area remotely from the assembly, if necessary. A pump means 75 is located in housing 12 and includes a first hose member 76, whereby activator solution 70 is pumped from reservoir 74 by a pump 75 through lines 76 and 78, line 78 being connected at one end to the output side of pump 75 and at its opposite end to liquid-dispensing bar 44. After passing over the respective papers fed through bar 44, the excess solution returns to the reservoir by means of a bath-collection tray 80. It should be noted that the bath assembly 18 is mounted within the collection tray, allowing the solution to return by way of drain 82 formed in tray 80, the drain being connected to reservoir 74 by a return hose 84. This arrangement of hoses, tray and pump allows for a continuous flow of the activating solution during the operation of the processor. The apparatus includes a drive means for rotating each set of rollers, the drive means comprising a single drive motor 85 located in control box 14. The drive motor is provided with a drive shaft 86 that is adapted to be coupled to a gear-train assembly, indicated generally at 85.

While operating the diffusion-transfer processor, a first loading or input tray 90 is attached to the front of the apparatus, and is mounted at an inclined position, its leading edge being located under the extending separator bar 34. This tray provides a means to align and prepare the material for processing. Mounted to the rear of the press rollers is an output tray 92 for receiving the papers after they pass through the rollers.

Figure 5:
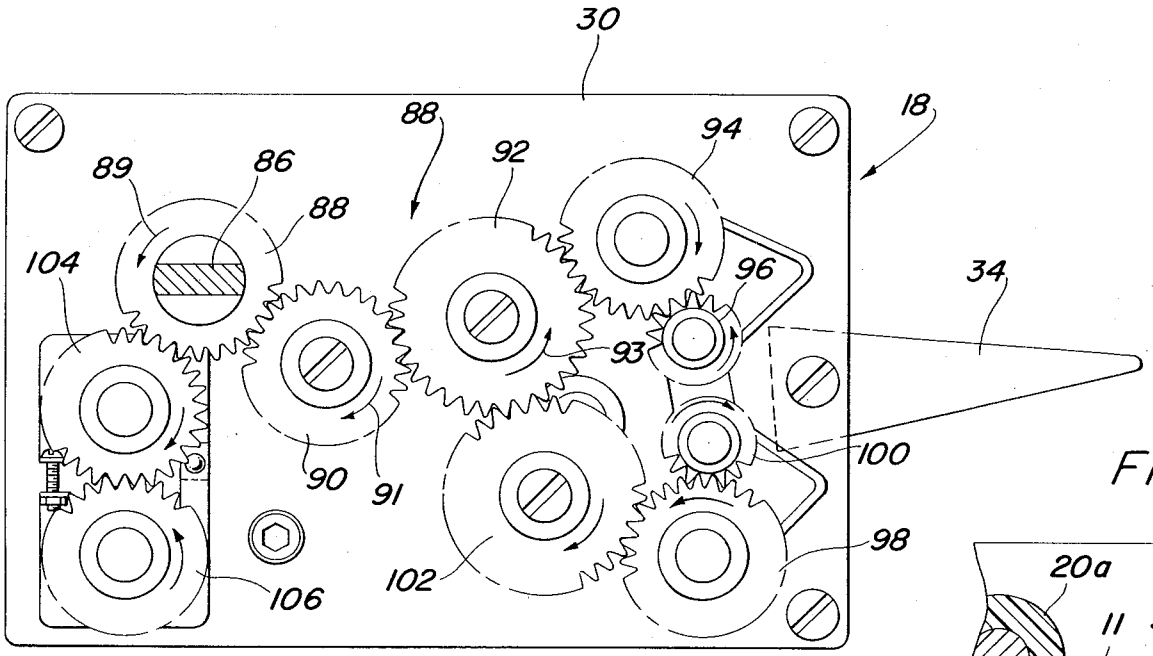
FIG. 5 is an enlarged view of the gear-train arrangement for driving the three sets of rollers, this view being taken substantially along line 5—5 of FIG. 2.

When the ON/OFF switch 94 is activated to ON, solution 70 is pumped from reservoir 74 into bath bar 44, as previously described; and motor 85 turns on and operates the various rollers for one cycle until it automatically resets. As illustrated in FIG. 5, drive shaft 86 rotates drive gear 88 in the direction of arrow 89, and gear 88 in turn drives intermediate gear 90 in the direction of arrow 91. This causes gear 92 to rotate in the direction of arrow 93, and gear 92 in turn to drive gear 94. Gear 94 is attached to transport roller 20*a* which drives gear 96 attached to transport roller 20*b*. Gears 94 and 96 have adjustable sizes, so that rollers 20*a* and 20*b* will feed paper 11 in a smooth continuous manner as the paper is placed on the upper wall of separator bar 34. Transport rollers 22*a* and 22*b* are also provided with respective gears 98 and 100 which are interconnected so as to be driven by gear 102. Accordingly, rollers 22*a* and 22*b* feed the lower paper 13 through the bath assembly, as seen in FIG. 4. Drive gear 86 is connected to adjacent gear 104 which is attached to press roller 32*a*, gear 104 being arranged to drive gear 106 attached to press roller 32*b*. Thus, all of the rollers are synchronized to rotate in their given direction by means of a single motor 85. At this time, material 11 is placed above separator 34, emulsion side down; and the second material 13 is placed below the separator, emulsion side up. The transport motor 85 is again started by using the start/reset switch 110, or by employing a foot switch (not shown) which would be connected to plug 111. This switch serves a dual function—either to start the transport motor or to reset it to the standby mode. Once activated, the switch will automatically reset after a few minutes; or, if another "stat" needs to be run before it turns off, it can be manually reset.

The aligned materials 11 and 13 are both fed into the respective transport rollers 20 and 22 at the same time. The materials are transported through the bath assembly, as herein described, and are deposited on the rear tray 92. The material must be allowed to sit undisturbed for the proper transfer time as required by the particular medium used. In order to regulate this, a transfer-timer-and-starter switch is provided at 112, there also being included an indicator light 114. Switch 112 can be selectively positioned for setting transfer times of approximately 30, 60, 90 or 120 seconds. Once the appropriate time is selected, the switch is pushed and the timer switch is released. The LED lights up and remains on for the selected period of time, and then it goes out so as to indicate when to peel apart the transfer materials 11 and 12.

Figure 6:
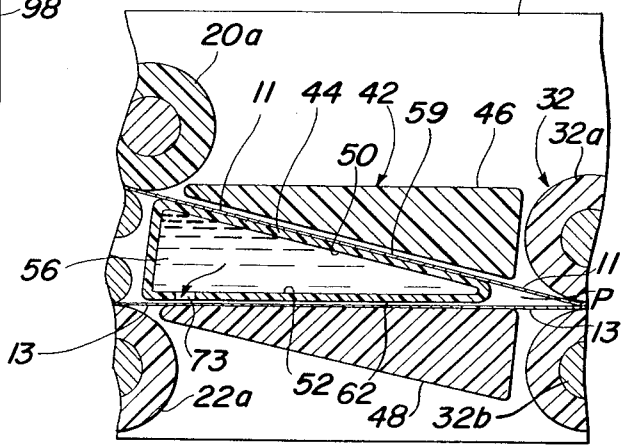
FIG. 6 is a cross-sectional view of part of the bath assembly showing an alternative arrangement, wherein the fluid outlet is positioned in the lower wall of the discharge bar.

Referring to FIG. 6, there is shown an alternative arrangement of the wedge-shaped, liquid-dispensing bar 44, wherein lower wall 52 thereof is provided with a plurality of discharge holes or an elongated longitudinal slot 73. Thus, with this arrangement, only the lower medium 13 passing through lower passageway 62 is totally bathed in the activator solution 70. The upper medium 11 is subjected to solution 70 only at point P, which is the small area just forward of the two mediums as they are brought into direct contact with each other—emulsion-surface-to-emulsion surface.

While the invention has been disclosed and described with reference to a single embodiment, it will be apparent that variations and modifications may be made therein, and it is therefore intended in the following claims to cover earh such variation and modification as falls within the true spirit and scope of the invention.

We claim:

1. An improved diffusion-transfer processor for photomechanical reproduction of artwork and like mediums, comprising:

a first upper pair of transport rollers positioned in parallel engagement with each other, and adapted to receive and transport a first medium rearwardly thereof;

a second lower pair of transport rollers positioned in parallel engagement with each other, and spaced below said first pair of transport rollers, said second pair of rollers being adapted to separately receive and transport rearwardly a second medium below said first medium;

means for continuously supplying an activator solution so as to bathe said mediums in said solution, as said mediums are transported rearwardly;

a third pair of rollers defining press rollers positioned rearwardly of said supply means, whereby said mediums are simultaneously received by said rollers, so as to press said mediums in direct contact with each other; and drive means coupled to at least one of said rollers, whereby all of said rollers are operably interconnected so as to rotate together in a synchronized relationship with respect to each pair of rollers, and to each roller of each pair, allowing said mediums to be in selected alignment with each other as they pass through said press rollers;

a pair of oppositely disposed end walls spaced apart and adapted to rotatably support each of said pairs of rollers;

a bath tray positioned under said rollers to catch said activator solution; and wherein said means for continuously supplying said activator solution comprises; a pump means a fluid-discharge member connected to said pump means and positioned rearwardly of said first and second transport rollers and forwardly of said press rollers, said discharge member having at least one discharge opening to allow said solution to bathe said mediums as they are transported rearwardly; and guide means positioned above and below said discharge member to guide said mediums, so as to be simultaneously received in said press rollers as said mediums are being bathed in said solution.

2. A diffusion-transfer processor as recited in claim 1, including a reservoir communicating with said bath tray to receive said activator solution therefrom and adapted to supply said activator solution to said pump, whereby said activator solution is pumped continuously in a closed system.

3. A diffusion-transfer processor as recited in claim 2, including:

a separator bar positioned forwardly and intermediately between said upper and lower transport rollers, whereby said first medium is positioned on the upper side of said separator bar so as to enter said upper transport rollers, and said second medium is positioned below said separator so as to enter said lower transport rollers;

an input tray positioned forwardly of said lower transport rollers and below said separator bar; and a rear support tray positioned rearwardly of said press rollers.

4. A diffusion-transfer processor as recited in claim 3, wherein said fluid-discharge member comprises an elongated tubular bar having a triangular cross-sectional configuration defined by an upper inclined wall and a lower inclined wall, said walls converging rearwardly and having a trailing edge located in front of said press roller, whereby said upper and lower mediums are directed between said press rollers after said mediums have been subjected to said activator solution.

5. A diffusion-transfer processor as recited in claim 4, wherein said guide means comprises:

an upper guide bar positioned above and adjacent said upper inclined wall of said fluid-discharge member, so as to define a passageway therebetween to receive said upper medium therethrough; and a lower guide bar positioned below and adjacent said lower inclined wall of said fluid-discharge member, so as to define a passageway therebetween to receive said lower medium therethrough.

6. A diffusion-transfer processor for photomechanical reproduction using a negative medium and a receiver medium, said processor comprising:

an elongated housing having a control box mounted at one end thereof;

a reservoir-support bracket attached to the opposite end of said housing;

a reservoir removably mounted in said support bracket to store an activator solution therein;

a pump means located within said housing;

a bath-collection tray supported by said housing and connected to said reservoir;

a bath assembly positioned in said bath tray, said bath assembly comprising:

a first pair of transport rollers positioned in parallel engagement with each other, and adapted to receive and transport rearwardly thereof a first medium;

a second pair of transport rollers positioned in parallel engagement with each other, and spaced below said first pair of transport rollers, said second pair of transport rollers being adapted to separately receive and transport rearwardly thereof a second medium below said first medium;

a liquid-dispensor bar positioned rearwardly of said first and second pairs of transport rollers, and having a triangular cross-sectional configuration defined by a base member positioned adjacent said rollers, and upper and lower inclined wall members that converge rearwardly of said base member, wherein at least one inclined wall includes a discharge opening formed therein, whereby said activator solution is pumped therethrough, so as to allow said mediums to be bathed as they pass thereover;

medium-guide means arranged above and below said liquid-dispenser bar, whereby liquid-flow passages are defined therebetween; and a pair of press rollers disposed rearwardly of said liquid-dispenser bar, and adapted to simultaneously receive both of said mediums therebetween, whereby said mediums are engaged while they are in a wet condition for image transfer between said mediums.

7. A diffusion-transfer processor as recited in claim 6, including:

drive means coupled to at least one of said rollers; and gear means operably interconnected to said rollers, whereby said rollers rotate together in a synchronized relationship relative to each other and to each pair of rollers.

8. A diffusion-transfer processor as recited in claim 7, wherein said processor includes:

an input tray positioned forwardly of said second pair of transport rollers; and a rear support tray positioned rearwardly of said press rollers.

9. A diffusion-transfer processor as recited in claim 8, including a separator bar positioned forwardly and intermediately between said first and second transport rollers, and above said input tray, whereby said mediums are selectively placed above and below said separator so as to be fed directly into the respective transport rollers.

10. A diffusion-transfer processor as recited in claim 6, wherein said upper inclined wall includes a discharge opening formed therein.

11. A diffusion-transfer processor as recited in claim 6, wherein said lower inclined wall includes a discharge opening formed therein.

* * * * *